United States Patent [19]

Mayer

[11] 4,236,701

[45] Dec. 2, 1980

[54] DEVICE FOR FIXING A PLANAR WORK PIECE

[75] Inventor: Herbert E. Mayer, Eschen, Liechtenstein

[73] Assignee: CENSOR patent- und Versuchs-Anstalt, Vaduz, Liechtenstein

[21] Appl. No.: 968,196

[22] Filed: Dec. 11, 1978

[30] Foreign Application Priority Data

Nov. 9, 1978 [DE] Fed. Rep. of Germany ..... 2848684

[51] Int. Cl.[3] ..... B25B 11/00

[52] U.S. Cl. ..... 269/21

[58] Field of Search ..... 269/21, 20; 279/3; 51/235

[56] References Cited

U.S. PATENT DOCUMENTS

| | | | |
|---|---|---|---|
| 477,305 | 6/1892 | Marsh | 269/21 |
| 2,317,348 | 4/1943 | Wekeman | 269/21 |
| 3,293,739 | 12/1966 | Hoglund et al. | 269/21 |
| 3,729,206 | 4/1973 | Cachon et al. | 269/21 |
| 3,787,039 | 1/1974 | Zeichman | 269/21 |
| 3,818,327 | 6/1974 | Alexander | 269/21 |

*Primary Examiner*—Robert C. Watson

*Attorney, Agent, or Firm*—Haseltine, Lake & Waters

[57] ABSTRACT

A device for fixing a planar work piece in position, particularly a semiconductor used in processing cycles for the production of integrated circuits. Said device having a supporting plane, a number of apertures being disposed in said supporting plane, said apertures being under reduced pressure, said work piece being pressed against said supporting plane by means of said reduced pressure. Said device being particularly suitable for precisely fixing a semiconductor substrate in the supporting plane, even in the case of extensive raised areas or warps on the lower side of the substrate. A number of independent reduced pressure systems are provided, said reduced pressure systems being connected with individual apertures or groups of apertures.

2 Claims, 3 Drawing Figures

DEVICE FOR FIXING A PLANAR WORK PIECE

BACKGROUND OF THE INVENTION

1. FIELD OF THE INVENTION

The invention relates to a device for fixing a planar work piece in position, particularly a semiconductor used in processing cycles for the production of integrated circuits, said device having a supporting plane, a number of apertures being disposed in said supporting plane, said apertures being under reduced pressure, said work piece being pressed against said supporting plane by means of said reduced pressure.

2. DESCRIPTION OF THE PRIOR ART

It is known in the art to fix planar work pieces in position by means of reduced pressure. When producing integrated circuits, a semiconductor substrate must be fixed onto a bench during certain processing cycles, e.g. when transferring photomasks onto a photo-sensitive layer of the semiconductor substrate. For this purpose a number of apertures communicating with a reduced pressure generating device are disposed in the bench surface so that the lower side of the substrate is pressed against the supporting plane.

It is one problem of such prior art devices that the lower side of the plate-shaped semiconductor substrate can have raised areas, which prevent the required building up of the reduced pressure. In this case the substrate surface does not coincide with the supporting plane, which may cause faults in the processing cycles.

This disadvantage is of great importance as substrates of increasing diameters have been developed, which may consequently have an increasing number of warps and raised areas on their lower sides.

Attempts have already been made to press the substrate against the bench by electrostatic means instead of by reduced pressure. Electrostatic contact pressure involves technical difficulties and high cost.

SUMMARY OF THE INVENTION

It is, therefore, the object of the invention to provide a device for fixing a planar work piece in position by means of reduced pressure, which makes a faultless fixing of the work piece possible, even in the case of extensive raised areas or warps on the lower side of the work piece and which is particularly suitable for precisely fixing a semiconductor substrate in the supporting plane.

According to the invention this is achieved by providing a number of independent reduced pressure systems connected with individual apertures or groups of apertures disposed in the supporting plane.

By independent reduced pressure systems is meant that in the case of increasing pressure in an aperture connected with a system the required reduced pressure is maintained in apertures connected with other systems.

It is surprising that even a substrate having a relatively uneven lower side can be securely fixed by means of such devices. As already mentioned, this is due to the fact that the reduced pressure in apertures fully covered by the substrate is built up independently of apertures being not fully covered. Those portions of the substrate which are precisely pressed onto the supporting plane also exert pressure on the raised portions so that the latter mentioned are also pressed into the supporting plane. It is of advantage to connect the apertures with independent reduced pressuure generating devices, preferably with the reduced pressure portions of Venturi tubes.

The apertures are advantageously adapted to lead into lowered areas, e.g. sector-shaped recesses of the supporting plane so that the work piece is pressed against webs disposed between said lowered areas in the supporting plane.

If grooves communicating with the surroundings are provided in the webs it is possible to detect portions of the work piece which are inaccurately positioned on the supporting plane even if said portions are surrounded by correctly positioned portions of the work piece.

For indicating the correct position of the work piece on the supporting plane gage means preferably measuring the flow rate of the fluid running through the apertures can be connected with the independent reduced pressure systems. Thereby those portions of the substrate can be defined which do not precisely rest on the supporting plane due to dirt particles between the lower side of the substrate and the supporting plane.

BRIEF DESCRIPTION OF THE DRAWING

In the following the invention will be described in more detail with reference to the figures of the drawing without being limited thereto.

DESCRIPTION OF A PREFERRED EMBODIMENT

Figure 1:
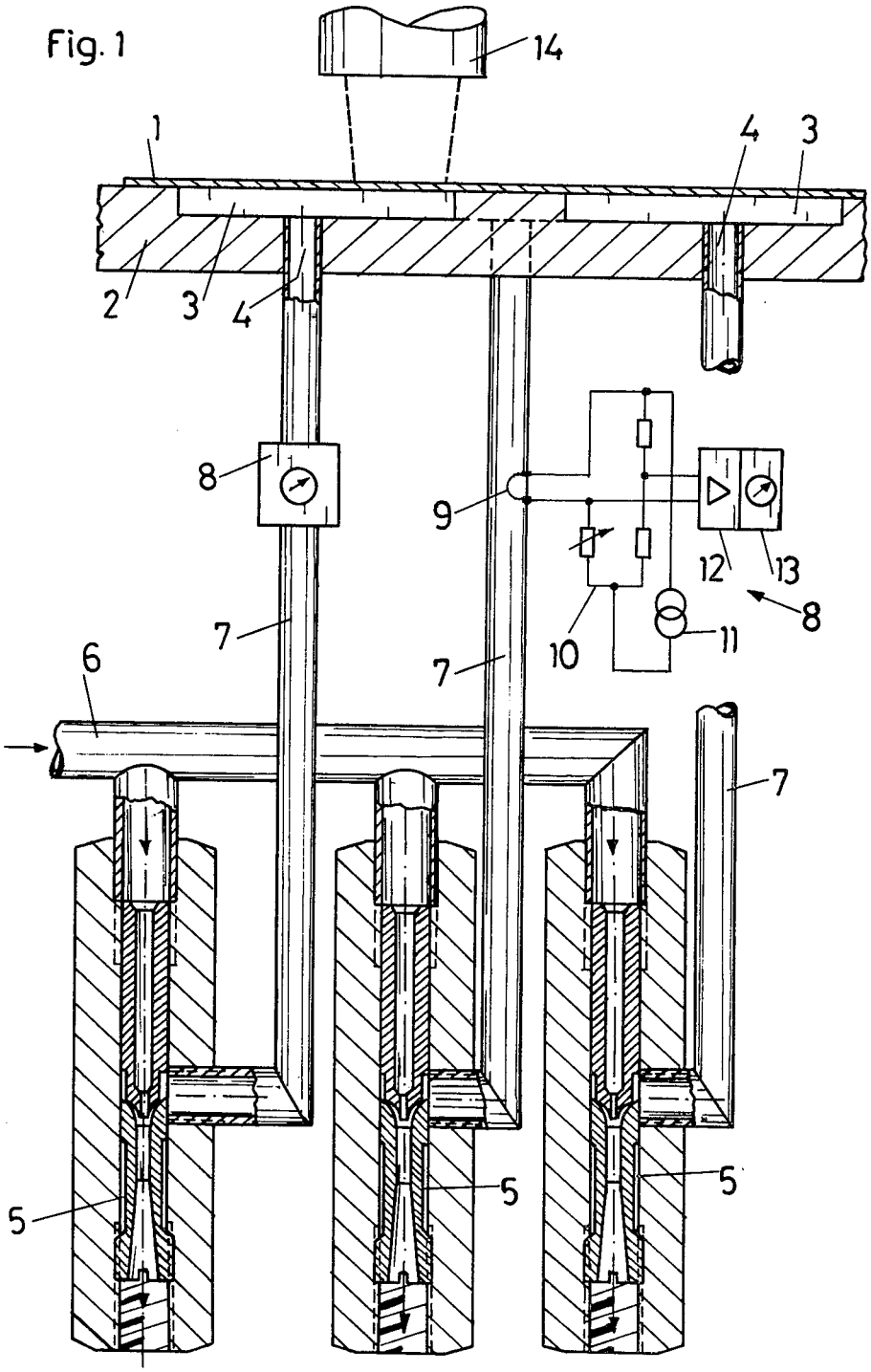
FIG. 1 shows a sectional view, in parts, of the device according to the invention for fixing a semiconductor substrate in position in the projection printing of circuit diagrams.

As illustrated in FIG. 1, the supporting plane for the substrate 1 is formed by the top surface of a bench 2. A projection objective 14 is positioned above the substrate for exposing a photo-sensitive layer disposed on the substrate.

Sector-shaped lowered areas 3 leading into apertures 4 are disposed in the surface of the bench 2. Said apertures 4 are connected with the reduced pressure portion of independent Venturi tubes 5 by means of reduced pressure tubes 7. The venturi tubes 5 are fed with a pressure medium by means of a common tube 6, and, thus, reduced pressure is built up in the apertures with respect to their surroundings. If a substrate 1 is disposed on the bench 2 it is precisely pressed against the webs 16 positioned between the lowered areas 3 independently of any warps created during production. As the apertures 4 are connected with independent reduced pressure systems uneven portions of the lower side of the substrate 1 do not effect a rise in pressure in all apertures 4, and finally the uneven portions are also pressed into their correct positions on the supporting plane by means of the internal forces exerted by correctly positioned substrate portions.

Gage means 8 indicating the correct position of the substrate are connected with the reduced pressure tubes 7. Said gage means 8 comprise a hot-wire anemometer whose temperature varies according to the flow of the fluid within the tube 7. Said hot-wire anemometer 9 is arranged in a bridge being fed by a constant power source 11. The voltage in the diagonal of the bridge being in proportion to the flow in the tube is forwarded to an amplifier 12 of a plotter 13.

Figure 2:
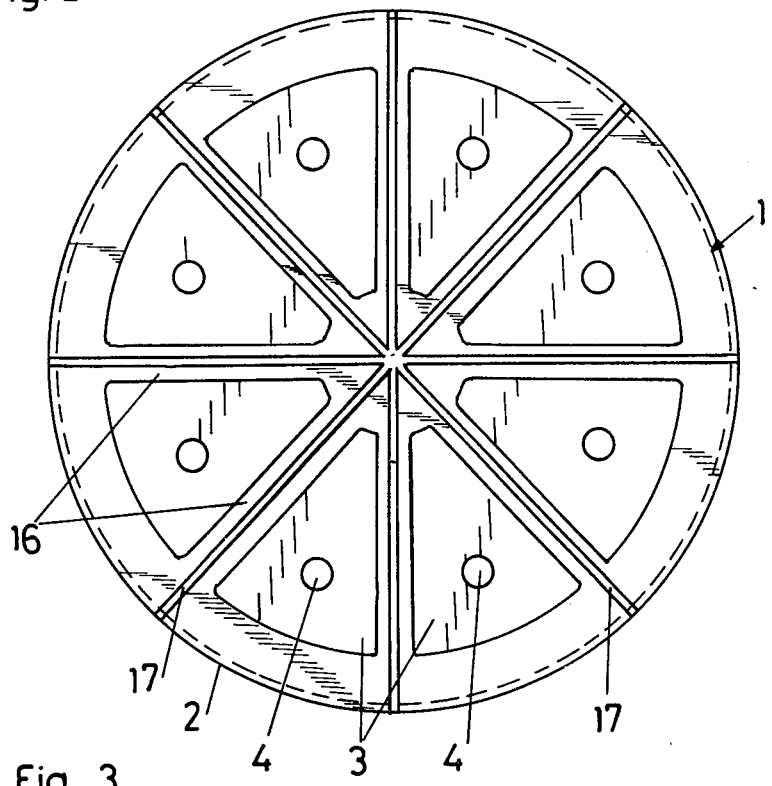
FIG. 2 shows the top view of a bench serving as a support of the semiconductor substrate.

Grooves 17 ending outside the supported area of the substrate 1 and, thus, communicating with the surroundings are formed in the surface of webs 16 of the bench 2 according to FIG. 2. Thereby a dirt particle can be detected, which is, for example, located in the center of the substrate 1 between said substrate and the bench, as the grooves 17 are not sealed from the lower side of the substrate against the lowered areas 3 resp. the apertures 4.

Figure 3:
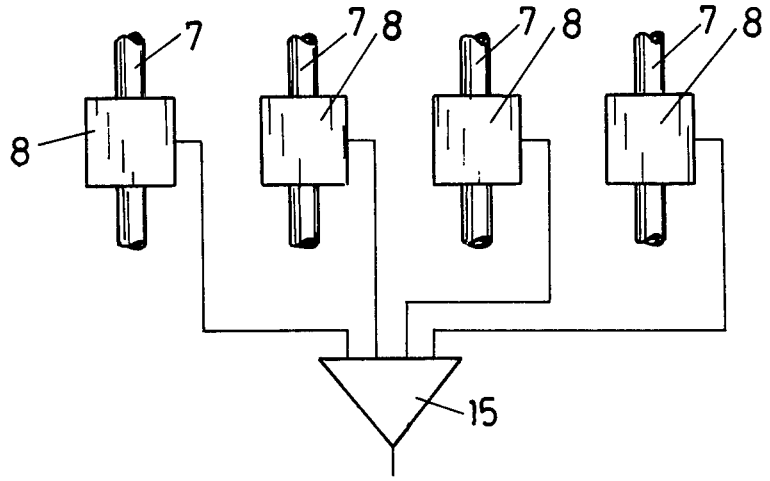
FIG. 3 shows an arrangement for detecting faults in substrate areas resting on the bench.

As indicated in FIG. 3 all output voltages of the gage means 8 may, for example, be forwarded to a comparator 15 whose output signal forms a criterion of the correct position of the substrate on the supporting plane. By means of the gage means 8 it is, furthermore, possible to locate dirt particles between the substrate 1 and the bench 2. It is, therefore, easy to detect such faults or excessively uneven substrates.

It will be possible within the scope of the present invention to provide lowered areas 3 of any other shape in the surface of the bench 2 as well as to use different reduced pressure generating devices and gage means.

What is claimed is:

1. An improved apparatus for fixing a planar work piece in position, particularly a semiconductor used in processing cycles for the production of integrated circuits, said apparatus being defined by a supporting plane; a number of apertures disposed in said supporting plane, each of said apertures are under reduced pressure by means of individual tubes; gage means being provided for measuring the flow rate of a fluid running through said individual tubes; and said work piece being urged against said supporting plane by means of said reduced pressure, said improvement comprises: providing a number of independent reduced pressure generating devices, each connected with one of said individual tubes, the outputs of said gage means being connected with a comparator, and an output signal of said comparator being criterion for the correct position of said work piece.

2. An improved apparatus according to claim 1, said improvement comprises: having a number of lowered areas in the supporting plane, said lowered areas being separated by webs; grooves being provided along said webs and terminating outside the supported area of said work piece on said supporting plane, each of said lowered areas having one of said apertures.

* * * * *